US005321910A

United States Patent [19]

Legendre et al.

[11] Patent Number: 5,321,910

[45] Date of Patent: Jun. 21, 1994

[54] ACTUATING DEVICE FOR A PIVOTAL CLOSURE MEMBER

[75] Inventors: Dominique S. Legendre; Gilles J. Troquet, both of Le Mans, France

[73] Assignee: Societe Corea, Societe Anonyme, Spay, France

[21] Appl. No.: 969,859

[22] PCT Filed: Jul. 31, 1991

[86] PCT No.: PCT/FR91/00633

§ 371 Date: Feb. 1, 1993

§ 102(e) Date: Feb. 1, 1993

[87] PCT Pub. No.: WO92/02704

PCT Pub. Date: Feb. 20, 1992

[30] Foreign Application Priority Data

Aug. 1, 1990 [FR] France ..... 90 09842

[51] Int. Cl.[5] ..... E05F 11/00

[52] U.S. Cl. ..... 49/324; 49/347; 49/357

[58] Field of Search ..... 49/324, 347, 357; 296/146

[56] References Cited

U.S. PATENT DOCUMENTS 4,249,771 2/1981 Gergoe et al. ..... 49/324 X
4,481,735 11/1984 Jentoft et al. .
4,918,865 4/1990 Hirai .
5,161,419 11/1992 Moy et al. ..... 49/324 X

FOREIGN PATENT DOCUMENTS 747564 4/1956 United Kingdom .
772015 4/1957 United Kingdom .

*Primary Examiner*—Philip C. Kannan
*Attorney, Agent, or Firm*—Young & Thompson

[57] ABSTRACT

Actuator device for a pivotable closure member such as a window or a pivoting vehicle roof, comprises a crank articulated at one end on the closure member and whose other end is connected to a rotatable member secured to one end of a cable arranged to roll up on and unroll from at least a portion of said rotatable member. The other end of the cable is fixed to a motor, for example a linear actuator. The connection between the articulated crank and the rotatable member (3) is effected by a conical pinion (4) in mesh with a toothed sector (5) on the rotatable member (3). The axis of the conical pinion is orthogonal to the axis of rotation of the rotatable member (3). The motor means is mounted on a support (12) secured to the rotatable member (3).

6 Claims, 4 Drawing Sheets

ACTUATING DEVICE FOR A PIVOTAL CLOSURE MEMBER

The invention relates to an actuating device for a pivotal closure member such as a window or pivotal roof of a vehicle of the type comprising a rod articulated at one end on said closure member and whose other end is connected to a rotatable member carrying one end of a cable arranged to roll onto and off at least a portion of said rotatable member, the other end of said cable being secured to a drive means.

The manually controlled actuating devices adapted to move a closure member of a vehicle, so as to bring it by pivotal movement from the open position to the closed position, or vice versa, whether by a device disposed in the vicinity of the element to be moved or by means of a remote actuating means, are known.

There is also known for opening side rear windows conventional systems of ball and socket joints which unfortunately are not accessible to the driver while driving. It has therefore been proposed to provide remote control devices which are for example disclosed in U.S. Pat. No. 3,740,093, FR-A-80.03229 and U.S. Pat. No. 4,918,865.

U.S. Pat. No. 3,740,093 relates to a device comprising a crank disposed on the side panel of the vehicle and connected to the actuating mechanism of the closure member by means of a flexible cable. The crank drives in rotation the cable which effects rotation of the actuating mechanism for opening and closing the forward window of the vehicle confronting that of the driver.

For its part, FR-A-80.03229 describes a device comprising two identical actuating members spaced from each other and interconnected by a flexible cable. The first actuating member is driven in rotation by a manual control handle directly accessible to the driver. The actuating member converts this movement of rotation into linear movement of the flexible member which then drives the rear actuating member which effects a new conversion of the movement and transmits this rotation movement to an articulated rod system of the overcenter type which connects the actuating member to the glass.

The devices described in these documents are relatively bulky and require effort by the user who must exert a rotative movement to actuate the assembly of the device.

There has also been proposed, in U.S. Pat. No. 4,918,865, a remote control system in which an end of a ball and socket joint for opening and closing the closure member is controlled by a drive means comprising an electric motor disposed remotely and two transmission cables rolling up on and unrolling from a drum according to the direction of rotation of the motor. The axle of the drum is fixed to the free end of the ball and socket joint. This known assembly is undesirably large as to the actuating mechanism. The mounting is extremely complicated because the motor is for example mounted at the bottom of the panel. Moreover, the length of flexible cable necessarily introduces imprecision of operation because of the play thus provided.

One of the objects of the invention is therefore to provide an actuating device with pneumatic control, of small size, permitting remotely controlling, by an occupant in the front of the vehicle, a pivoting movement of a closure member such as a window or pivoting roof of the vehicle, between a closed and an open position.

To this end, the control device according to the invention is characterized in that the connection between the rod articulated to the rotatable member is effected by means of a conical pinion meshing with a toothed sector of said rotatable member, the axis of said conical pinion being substantially orthogonal to the axis of rotation of said rotatable member, the drive means being constituted by a linear pneumatic actuator mounted on the support secured to said rotatable member.

To permit the rotation of the rotatable member in both directions, the first cable can be prolonged by a second cable whose one end is carried by the rotatable member and whose other end is secured to a second actuator with linear movement or a double acting actuator. It is also possible to provide an elastic return means in the vicinity of the rotatable member, said elastic means subjecting the rotatable member to a movement of rotation in a direction opposite that controlled by the actuator.

Other characteristics, variations and advantages of the invention will become apparent from a reading of the description which follows with regard to the accompanying drawings, which description and drawings are given only by way of examples. In these drawings.

Figure 1:
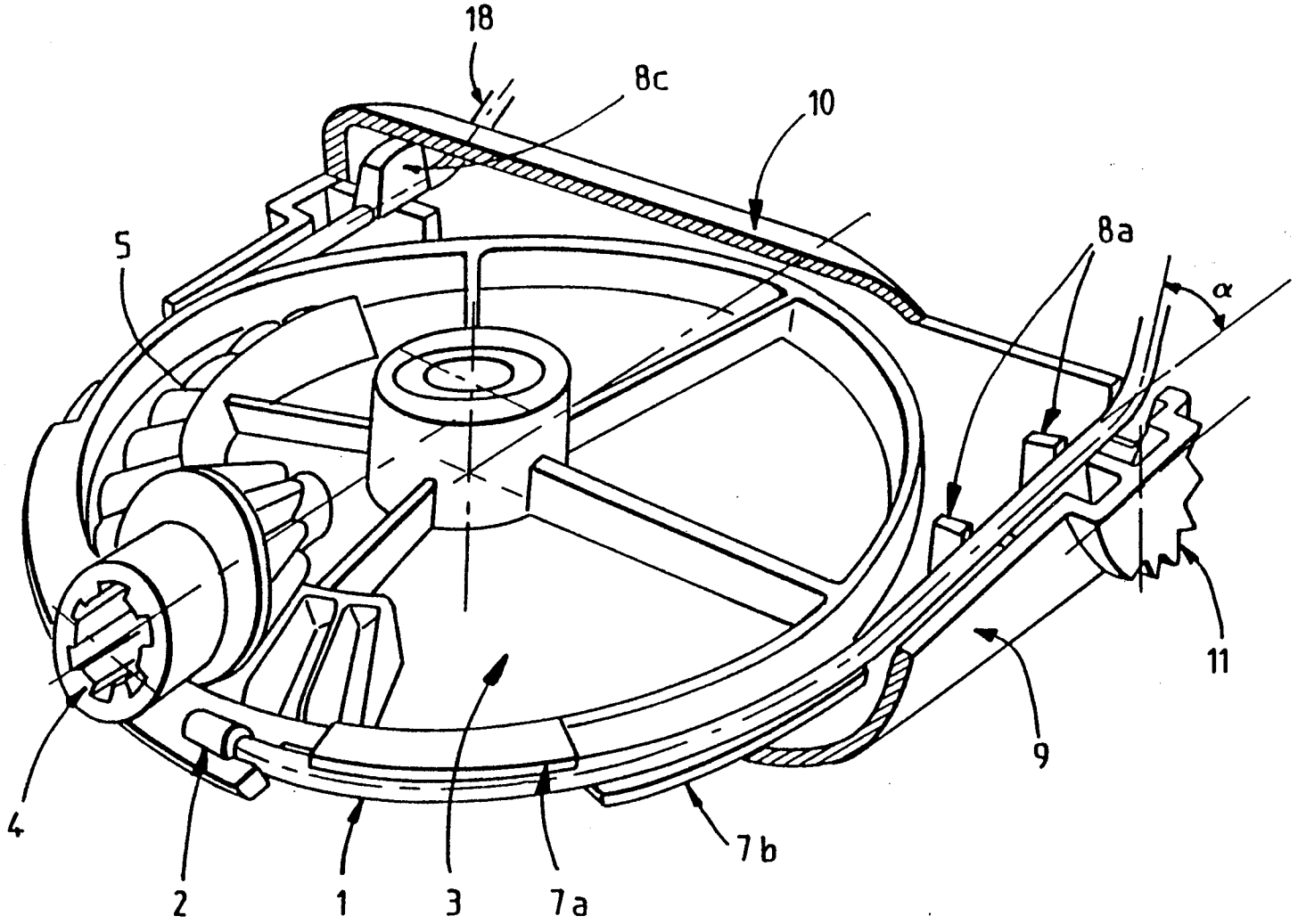
FIG. 1 is a fragmentary perspective view of an actuating device according to the invention.

In accordance with FIG. 1, the control member comprises a conical pinion 4 in mesh with a toothed sector 5 in the shape, for example, of a crown, integral with the rotatable member 3. The rotatable member 3 is provided with an axial recess permitting the reception of the axle of rotation. This axle, integral with the lower element 9 of the casing, is constituted by a projection of said element or by a rod connected to said element. At a fixed position 2 on the rotatable member 3 is secured a cable 1. This cable 1, adapted to roll up on and unroll from at least a portion of the rotatable member 3, is maintained in contact with said member 3 by radial projections **7*a* and 7*b* integral with the rotatable member 3. It is also possible, according to an unillustrated embodiment, to omit the radial projections and to replace them by a groove provided in the periphery of the rotatable member 3. In this case, if the rotatable member 3** is of circular shape, it will constitute a pulley.

The other end of cable 1 is secured to a linear movement actuator 6. The actuator or pneumatic jack 6 comprises a body in the interior of which is disposed a deformable membrane. This membrane delimits a chamber adapted to be subjected either to atmospheric pressure or to a vacuum thanks to a tube carried by the body of the jack. This tube is adapted to be interconnected, by means of a valve, to a source of vacuum. This actuator could comprise several membranes so as to delimit several chambers thereby permitting the cable to have several positions between the two end positions.

Figure 4:
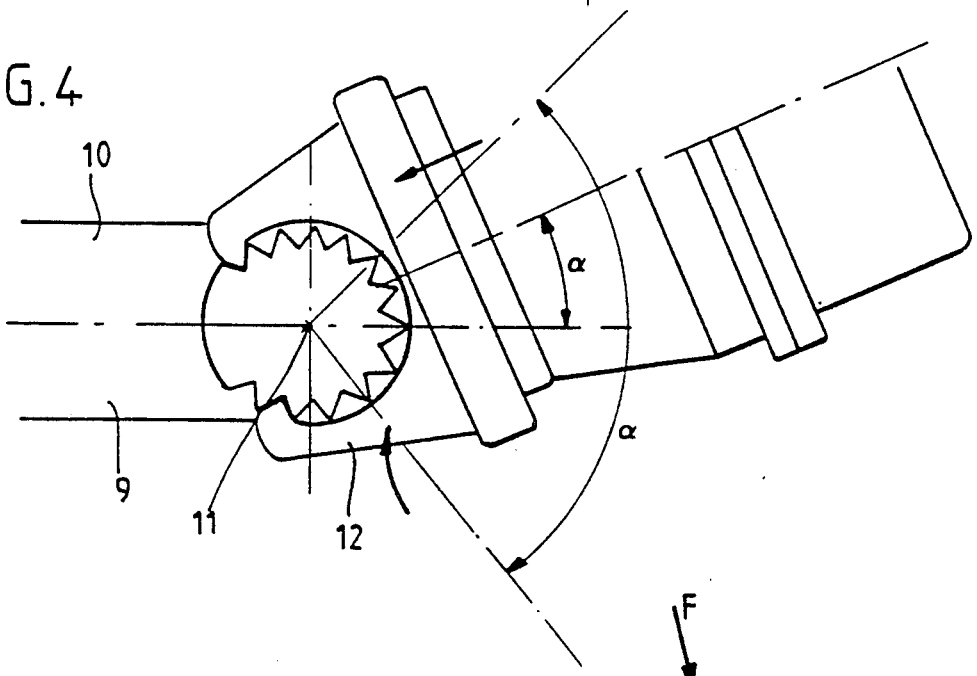
FIG. 4 is a simplified elevational view of the connection actuator/control member.

The actuator 6 is disposed adjacent the control member and is connected to this latter by a support 12 ending in jaws coming into engagement with a toothed sector 11 carried by the lower and respectively the upper element of the casing. The teeth of the sector 11 coact with complementary provisions of the tooth type disposed at the end of the jaws of support 12. These teeth permit varying the position of the actuator over an angle $\alpha$ according to FIG. 4. This angle $\alpha$ is determined at the time of assembly.

The lower element and the upper complementary element of the casing are juxtaposed on each other and maintained in assembly thanks to, for example, rivets, and are provided in the upper portion of one of their lateral ends, with notches or openings 19 which permit providing an opening for the passage of cable 1. The lower and upper elements of the casing also comprise lugs 8*a*, 8*b* and 8*c* disposed in a triangle so as to maintain the cable in position.

To permit the rotation of the rotatable member in both directions, the cable 1 is prolonged by a second cable 18 one of whose ends is fixed at 2 to the rotatable member and whose other end is secured to a second linear movement actuator. The two actuators are thus, according to a configuration in accordance with FIG. 1, disposed side by side. According to another embodiment of the invention (not shown), it is also possible to replace the second actuator by an elastic return means disposed in the vicinity of the rotatable member, said elastic means subjecting the rotatable member 3 to a movement of rotation in a direction opposite that controlled by the actuator.

It is possible to use only a single cable and a single pneumatic actuator 6 by subjecting the rotatable member to the action of return means (not shown).

It is also possible to use a single pneumatic actuator 6 controlling the two cables 1 and 18. According to one embodiment, the free end of the second cable is connected to the membrane of the actuator 6 whose chambers can be connected alternatively to vacuum and to the atmosphere or to a positive pressure. There is obtained in this latter case an elevated torque on the rotatable member 3.

Figure 2:
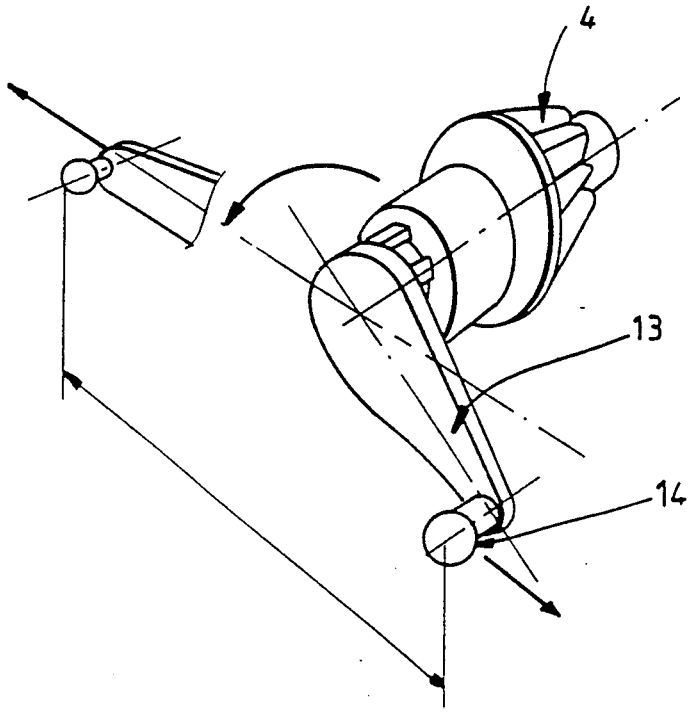
FIG. 2 is a fragmentary perspective view of the crank system.

According to FIG. 2, the conical pinion 4 is fixed in rotation with a crank 13 connected by means of a roller 14 to another crank (not shown), said crank being itself connected in conventional manner by piercing and upsetting to the closure member.

To reduce the size, there can be provided between the crank 13 and the conical pinion 4 a shaft (not shown) connected to a transmission gearbox which carries said crank 13. The useful length of the shaft could be adjustable, for example by a sliding of the shaft coaxially of the conical pinion.

Figure 5:
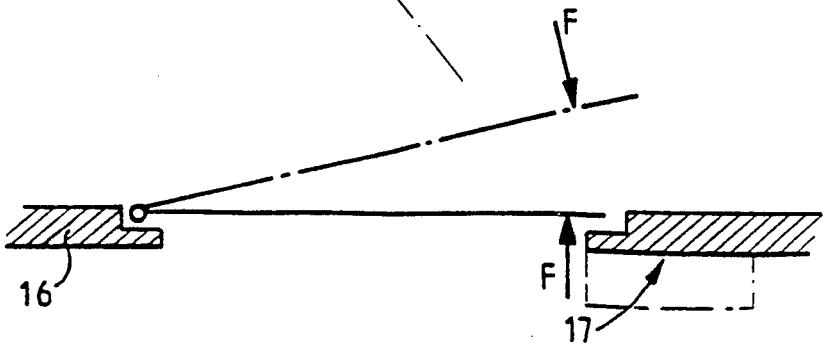
FIG. 5 is a schematic representation of the positioning of the control member relative to the closure member.
Figure 3:
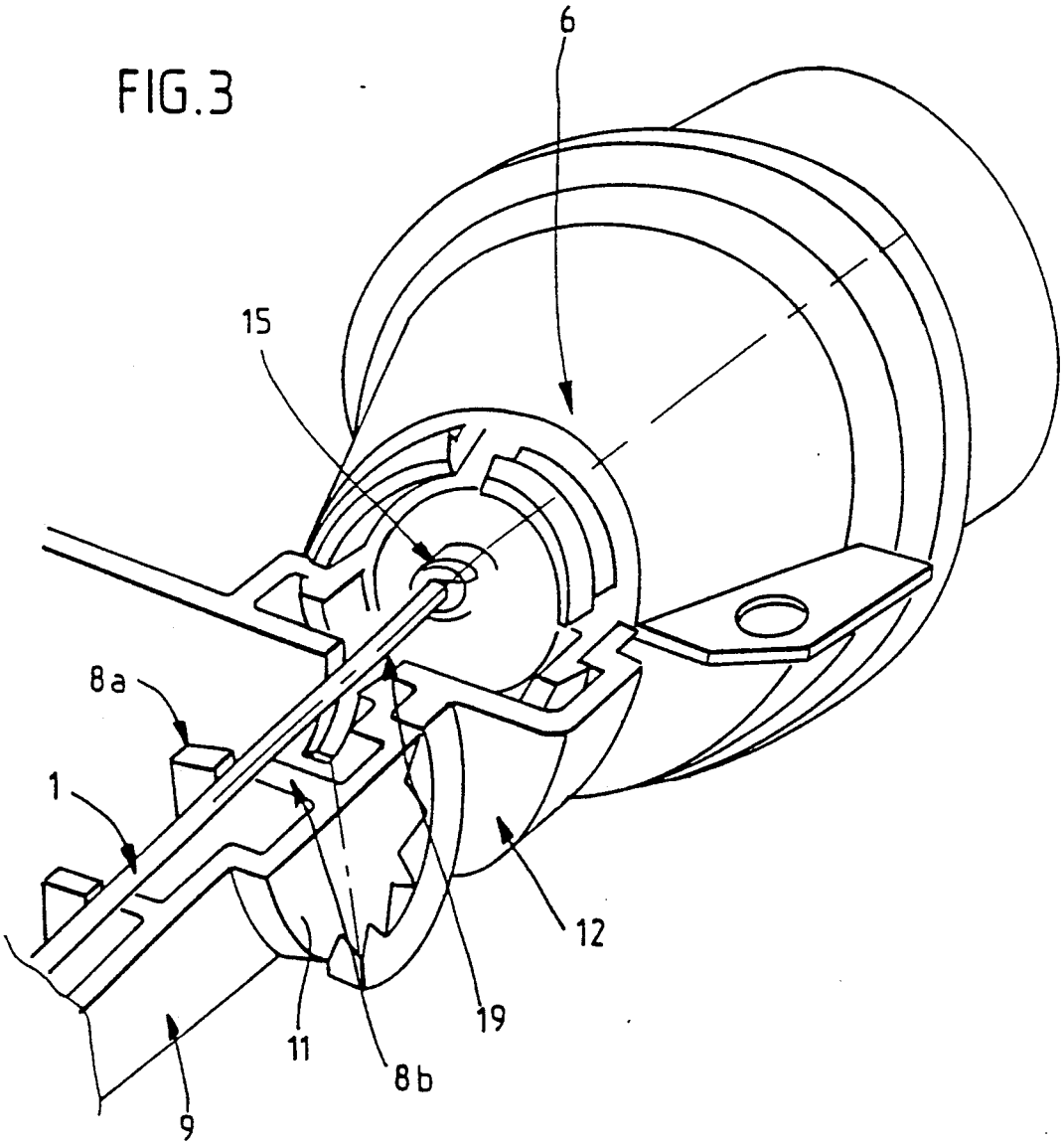
FIG. 3 is a perspective view of the connection actuator/control member.

In operative position, and according to FIG. 5, actuating device 17 is disposed on the panel of the chassis adjacent a freely swinging edge of the closure member and opposite the articulated edge.

Figure 6:
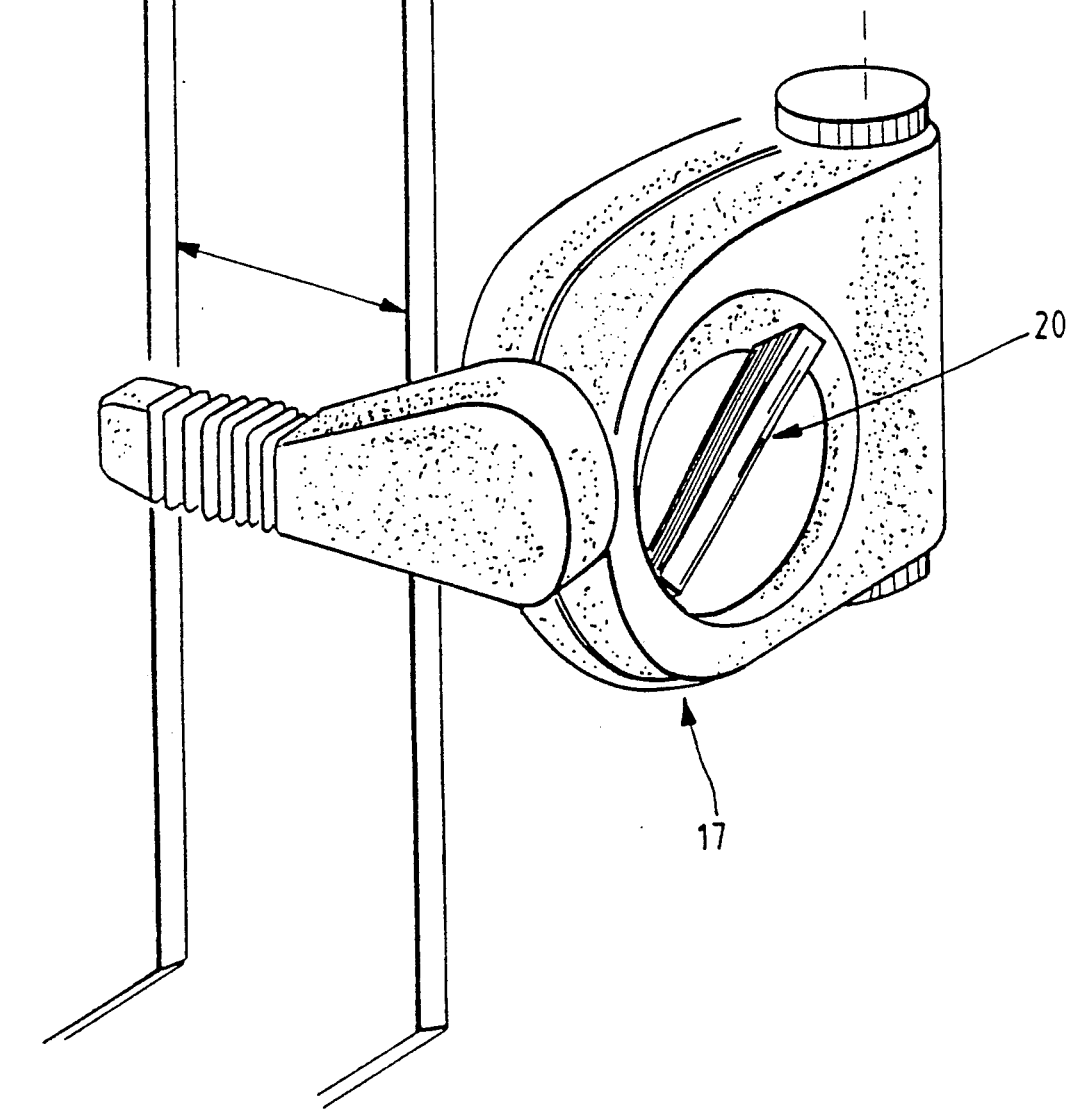
FIG. 6 is a perspective view of the actuating device in operative position.

The control of the actuators is effected by switches disposed on the dashboard. However, for safety reasons, this control could also be effected manually. Thus, according to FIG. 6, the rotatable member is provided with a transverse ridge 20 which permits one of the occupants of the vehicle to control manually the movement of the rotatable member when the actuators indicate a malfunction.

When one of the chambers of one of the actuators is subjected to vacuum, the membrane deforms and exerts traction on the cable. The cable then drives in rotation the rotatable member 3 and the toothed sector 5 integral with the rotatable member 3. The displacement of the toothed sector 5 in mesh with the conical pinion 4 drives in rotation said pinion 4 which itself is secured in rotation to the crank 13 sunk in the pinion 4. The crank 13 transmits, by means of the roller 14, its pivoting movement to the second crank which then controls the opening of the closure member.

The closing of the closure member can be controlled by a second actuator exerting opposite traction on the cable. In this case, when the chamber of one of the actuators is subjected to vacuum, the chamber of the other actuator is at atmospheric pressure, and vice versa. But the closing of the closure element can also be controlled by a return element, for example a tension spring disposed adjacent the control member and exerting a return force on said cable.

The invention is not limited to the embodiments shown but comprises on the contrary all variations of embodiment within the scope of the invention.

We claim:

1. Actuator device for a pivotable closure member such as a window or a pivoting vehicle roof of the type comprising a crank articulated at one end on said closure member and whose other end is connected to a rotatable member secured to one end of a cable arranged to roll up on and unroll from at least a portion of said rotatable member, the other end of said cable being fixed to a motor means, characterized in that the connection between the articulated crank and the rotatable member (3) is effected by means of a conical pinion (4) in mesh with a toothed sector (5) on said rotatable member (3), the axis of said conical pinion being substantially orthogonal to the axis of rotation of said rotatable member (3), the motor means being mounted on a support (12) secured to said rotatable member (3).

2. Actuator device according to claim 1, characterized in that said cable (1) is prolonged by a second cable (18) whose one end is carried by the rotatable member (3), said cables (1, 18) being disposed in such a way that traction on one or the other of the cables (1, 18) drives the rotatable member (3) in rotation in one direction or the other.

3. Actuator device according to claim 1, characterized in that the rotatable member (3) comprises radial projections (7*a*, 7*b*) for guiding the cable.

4. Actuator device according to claim 1, characterized in that the assembly of the device, except the actuator (6), is disposed within a casing (9) constituted by two elements of complementary shape and juxtaposed on each other, the two elements being provided with projecting portions (8*a*, 8*b*, 8*c*) and recesses so as to form a guide conduit for the cable and to provide openings (19) for the passage of the cable to the exterior of the casing (9).

5. Actuator device according to claim 4, characterized in that at least one of the elements of the casing (9) comprises a projecting portion which is received within an axial opening of the rotatable member (3) to constitute the rotation axle of the rotatable member (3).

6. Actuator device according to claim 4, characterized in that the elements of the casing (9) are provided at one of their ends with a toothed sector (11) for prepositioning adapted to coact with complementary means carried by the support (12) of the actuator so as to permit a variation of angular position of the actuator (6) at the time of assembly.

* * * * *